US011499760B2

(12) United States Patent
Wajda

(10) Patent No.: US 11,499,760 B2
(45) Date of Patent: Nov. 15, 2022

(54) HVAC ON DEMAND VIA HIGH AND LOW PRESSURE VORTEX SEPARATION APPARATUS WITH ROTATING SPIN CHAMBER

(71) Applicant: Robert G. Wajda, Jacksonville, FL (US)

(72) Inventor: Robert G. Wajda, Jacksonville, FL (US)

( * ) Notice: Subject to any disclaimer, the term of this patent is extended or adjusted under 35 U.S.C. 154(b) by 67 days.

(21) Appl. No.: 17/233,733

(22) Filed: Apr. 19, 2021

(65) Prior Publication Data

US 2021/0341181 A1 Nov. 4, 2021

Related U.S. Application Data

(60) Provisional application No. 63/018,221, filed on Apr. 30, 2020.

(51) Int. Cl.

| | |
|---|---|
| ***F25B 9/04*** | (2006.01) |
| ***F25B 29/00*** | (2006.01) |
| ***F25B 30/06*** | (2006.01) |

(52) U.S. Cl.

CPC ..... *F25B 9/04* (2013.01); *F25B 29/003* (2013.01); *F25B 30/06* (2013.01)

(58) Field of Classification Search

CPC ..... F25B 9/04; F25B 29/003; F25B 30/06; F24F 5/001; B04C 5/04; B04C 5/103; B04C 5/107; B04C 5/13; B04C 5/181; B04C 9/00; B01D 45/12; B01D 45/16

See application file for complete search history.

(56) References Cited

U.S. PATENT DOCUMENTS

| | | | | |
|---|---|---|---|---|
| 2,720,091 | A * | 10/1955 | Schelp | F24F 5/0085 62/305 |
| 2014/0090366 | A1* | 4/2014 | Akbar | F03D 9/25 60/398 |
| 2017/0146242 | A1* | 5/2017 | Meadows | F23D 14/64 |
| 2019/0242359 | A1* | 8/2019 | Rider | F03D 1/025 |

* cited by examiner

*Primary Examiner* — Miguel A Diaz
*Assistant Examiner* — Ibrahim A. Michael Adeniji

(57) ABSTRACT

The HVAC On Demand Via High And Low Pressure Vortex Separation Apparatus With Rotating Spin Chamber is a novel heating and cooling system that could revolutionize the HVAC industry. The instant invention takes in ambient air, via ducted fans, and separates hot and cold air by spinning the air molecules into a self-contained vortex. Specifically, it allows the less dense hot air molecules to pass through the front of the invention while diverting the cold air molecules through a series of reversing tubes to exit the apparatus. As the main rotating spin chamber spins ambient airflow into a centrifugal vortex in one direction, the air inlet tubes are positioned in such a way that it allows the rotating spin chamber to revolve in the opposite direction of the interior vortex. This captures all mechanical energy on the inside and outside of the vortex. The apparatus takes otherwise wasted mechanical energy and converts it into additional electrical energy. The entire invention along with understanding how air separation on a molecular scale works, allows the invention to be scaled to any size and configuration for an incredibly high efficiency rate.

1 Claim, 8 Drawing Sheets

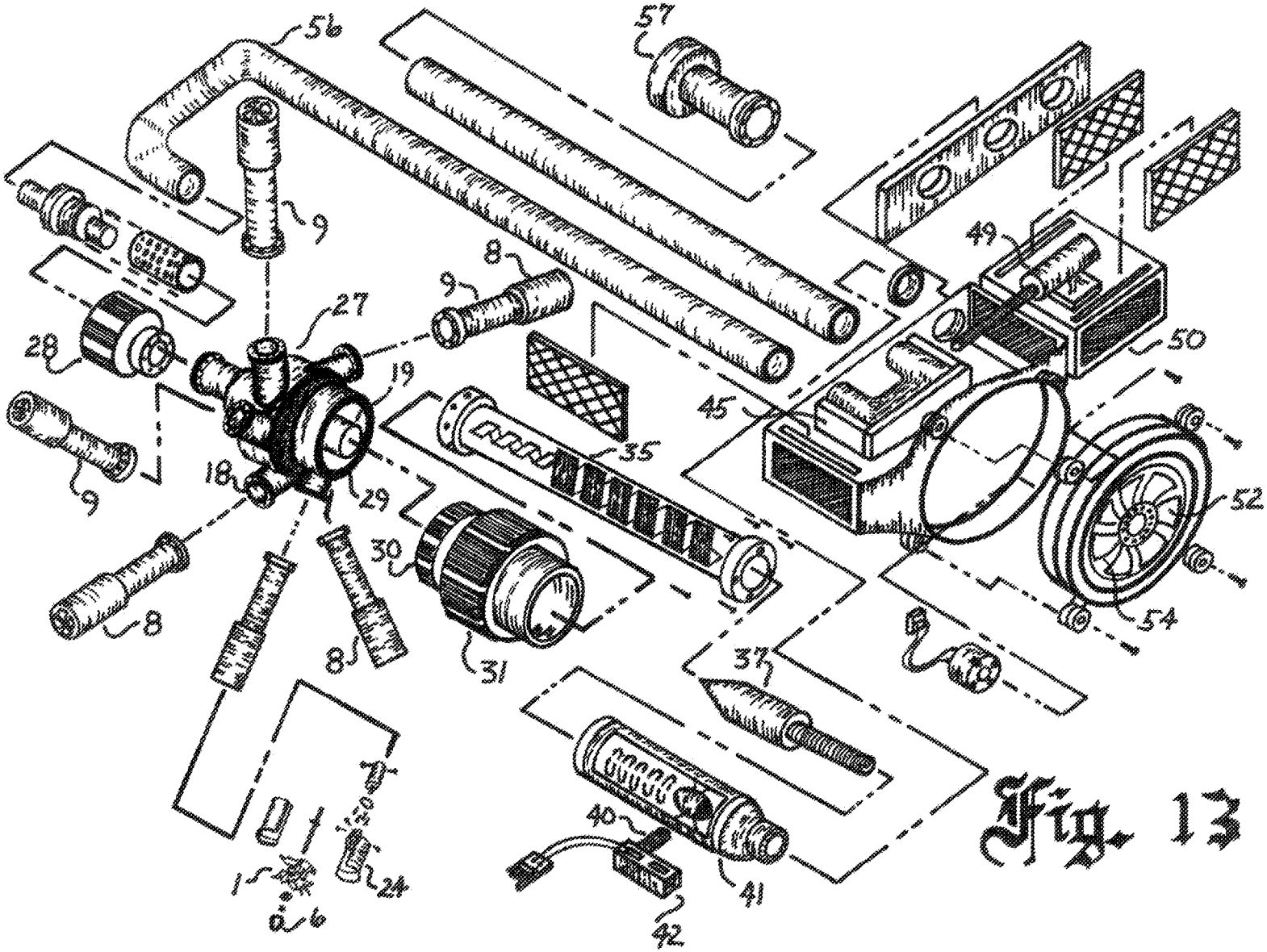
图13

HVAC ON DEMAND VIA HIGH AND LOW PRESSURE VORTEX SEPARATION APPARATUS WITH ROTATING SPIN CHAMBER

CROSS REFERENCE TO RELATED APPLICATIONS

This application is a continuation-in-part of Ser. No. 63/018,221, filed Apr. 30, 2020.

BACKGROUND

Field of the Invention

The field of the invention relates to a rotating scalable heating and cooling apparatus that receives in ambient air, via ducted fans, and separates the drawn air into hot and cold states by spinning it into a self-contained vortex. More precisely, it allows the hot air (less dense) molecules to pass through the front opening while not allowing the cold air molecules to pass through. The larger dense cold air molecules have nowhere to go so they are forced onto the tip and angle of the exposed surface of the V-Cone and travels the path of least resistance down the center of the outer vortex which is creating a constant vacuum. As the main rotating spin chamber spins the airflow into a centrifugal vortex in one direction, around the horizontal tube, the air inlet tubes are positioned in such a way that the centrifugal force allows the rotating spin chamber to rotate in the opposite direction. The use of rotating magnetic levitation attachments, or the like, in combination with the on-board generators allows the invention to convert mechanical energy into electrical energy. The entire invention along with the understanding how air separation on a molecular scale works, allows the invention to be scalable of any size and configuration with an incredibly high operating efficiency rate.

Description of the Prior Art

U.S. Pat. No. 1,952,281 issued on Mar. 27, 1934 to Ranque Georges Joseph discloses an invention that relates to a method for automatically obtaining from a compressible fluid (gas or vapor) under pressure, a current of hot fluid and a current of cold fluid, that transformation of the initial fluid into two currents of different temperatures taking place without the help of any movable mechanical instrument, merely through the work of the molecules of fluid upon one another.

U.S. Pat. No. 2,907,174 issued on Oct. 6, 1959 to Hendal Willem Pieter discloses an invention that relates to a method of operating a vortex tube within which a gas stream is expanded with gyratory motion about the tube axis to separate the gas into hot and cold fractions, and from which tube gas is discharged continuously in a manner dependent upon the particular purpose to which the tube is put, and to an improved vortex tube.

U.S. Pat. No. 3,208,229 issued on Sep. 28, 1965 to Charles Da Fulton discloses an invention that relates to improvements in vortex tubes and more specifically to the design and construction of vortex tubes capable of emitting colder and hotter streams of gas, operating more efficiently, being more compact and more cheaply manufactured, and being more readily applied to useful purposes.

U.S. Pat. No. 3,461,676 issued on Aug. 30, 1969 to Lester W. Toelke and Irven E. Hanson discloses an invention that relates to improvements in a vortex tube apparatus wherein a vortex tube converter is provided for receiving a gas from an inlet tube and converting it into a hot portion and a cooler portion.

U.S. Pat. No. 4,302,949 issued on Dec. 1, 1981 to Antonio A. Trimboli Longhetto discloses an invention that relates to heating and cooling in a controlled manner. The invention can be used, for example, for thermal conditioning of areas used for industrial purposes, and for the air-conditioning of domestic environments.

U.S. Pat. No. 5,327,728 issued on Jul. 12, 1994 to Lev E. Tunkel discloses an invention relates to vortex tubes. More particularly, the present invention relates to design and construction of vortex tubes.

The use of vortex tubes to implement systems for emitting hot and cold gas streams are well known. The above aforementioned patents use a compressed gas source, via a stationary compressor and hose, to connect to the apparatus. This limits their efficiency, size, and ability to be scaled. None of the above inventions and patents, by themself or in combination of some type, is seen to describe the instant invention as claimed.

SUMMARY OF THE INVENTION

The HVAC On Demand Via High And Low Pressure Vortex Separation Apparatus With Rotating Spin Chamber is designed for heating and cooling applications for residential, commercial, industrial, maritime, and United States Military purposes. The heating and cooling device includes a plurality of ducted fans, air delivery tubes, air backflow stops, a rotating spin chamber that has a plurality of uniquely configured baffle extensions, a horizontal tube, charging generators, using magnetic levitation design attached to bearing housing or the like, a main airflow separation tube, a V-Cone and VorxScrew Assemble, a series of gear mechanisms and motors, a variable heat pump exchanger, a main turbine fan, a series of reversing tubes, and an assisting exit fan.

In its simplest form, the ducted fans when turned on take in surrounding ambient air into a series of air delivery tubes. These airflow delivery tubes have air backflow stops that keep airflow traveling in one direction in the event of a ducted fan malfunction. As soon as the airflow exits air delivery tubes, it enters a series of openings in the rotating spin chamber. As the ambient airflow enters, it is passed through a plurality of interior baffles that extend into the center of the rotating spin chamber. These baffle extensions are configured in such a way that it spins an efficient vortex of air, even at its lowest setting.

As the vortex starts spinning around the horizontal tube, the interior left wall of the spin chamber forces the vortex to travel in one direction toward the front of the unit through the main airflow separation tube. Volumes of air flow into the main airflow separation tube. This allows the apparatus to not be limited to any particular size with scaling achievable. As the vortex of air travels to the end of the main airflow separation tube, the vortex is tightened into a more compressed state as it approaches the V-Cone assembly. As this happens, it separates the air molecules into hot and cold separate states. The hot air molecules become less dense and more separated, while the cold air molecules become more dense and heavier.

This V-Cone assembly is not limited to any particular configuration or size for its purpose is to allow the less dense hot air molecules to pass through the opening while forcing the larger and more dense cold air molecules onto the exposed angular surface of the V-Cone. The cold air molecules have no where to go, so they take the path of least resistance and automatically travel in the opposite direction through the center of the outer vortex. This simple approach of allowing the hot air molecules to pass through the front opening and not allowing the cold air molecules to pass through is what separates the air into hot and cold airstreams. The more closed the V-Cone position is, the hotter the hot end gets. The cold end also simultaneously changes with temperature drop in conjunction with a more closed V-Cone position. At the same time, the faster the ducted fans are moving, it has the same effect; the hot end of the apparatus becomes hotter and the cold end simultaneously becomes cooler. This feature allows a dual temperature control system for the air based on the speed of the fans and the positioning of the V-Cone.

Once the hot air is allowed to pass though the opening, it enters a heat pump exchanger. This heat pump exchanger has a 180-degree fitting that is attached to a motor that allows it to be placed in an open or closed position. When the heat pump exchanger is in a open position it allows the hot air to be mixed with ambient air also drawn in through the device, thus conditioning the air for heating and cooling areas with ventilation while exiting the front of the unit through the main turbine fan. At the same time, the cold air enters the 180-degree fitting and reversing tubes and is redirected out the back of the apparatus. In contrast, when the heat pump exchanger is in the closed position the hot air enters the 180-degree fitting and is redirected to the back of the unit while simultaneously allowing the cold air to exit through the front main turbine fan.

As this entire process is occurring in real time while the apparatus is initially turned on, the rotating spin chamber begins to spin in the direction opposite of the interior vortex created. As the inner vortex, shown in the drawings, is spinning counterclockwise the rotating spin chamber itself rotates in a clockwise direction. Vice versa, if the inner vortex spins clockwise, the rotating spin chamber revolves counterclockwise. In these drawings, the rotating spin chamber spins in a clockwise direction from the vacuum created by the ducted fans. As the rotating spin chamber spins in this clockwise direction, the vacuum created by the ducted fans removes airflow from the trajectory of the spin chamber's revolution, thus reducing unwanted resistance and allowing it to rotate even faster. Also, since the inner vortex of the spin chamber is spinning in the opposite direction, it creates a centrifugal force which allows the rotating spin chamber to spin even faster. Further, by adding magnetic levitation attachments, or the like with bearing house placement(s), it removes unwanted friction otherwise caused by standard bearing systems. This speeds up the revolutions of the rotating spin chamber even more. The rotating spin chamber is designed in such a way that it is configured to spin at an incredible speed with the least amount of friction. This allows extremely high operating rates of efficiency. As the rotating spin chamber spins, it activates a plurality of on board electrical generators that take the otherwise wasted mechanical energy and converts it into electrical energy. This electrical energy is recycled back into the invention, via onboard power inverters, and increases the overall efficiency of the entire apparatus.

One objective of the invention is to provide a scalable heating and cooling system with limited moving parts to provide on demand temperature control settings, via high and low pressure vortex separation, with no use of any compressors, attached hoses, or refrigerants.

Also, an objective of the invention is to have pluralities of extended baffle extensions that protrude into the spin chamber, whereas each one is positioned differently than the one it precedes.

Accordingly, it is a principal objective of the invention to create an advanced rotating spin chamber that is configured in such a way to convert mechanical energy into electrical energy. This will be accomplished by spinning a self-contained vortex in one direction through the center of the rotating spin chamber, while the entire rotating spin chamber spins in the opposite direction using the effect of the vacuum created by the ducted fans. This process in combination with the onboard charging generators positioned on both sides of the rotating spin chamber allow the invention to operate at maximum efficiency.

Still yet, objectives of the invention are to create a main airflow separation tube that can be scaled, which separates ambient air into hot and cold airstreams by separating hot air molecules from the cold air molecules and only allowing the less dense hot air molecules to pass through the front opening.

It is a further objective of the invention to have a scalable heat pump exchanger that allows the hot and cold air to change directions by utilizing a motor that moves a 180-degree fitting into alternate positions.

When the invention is turned on it creates hot and cold air simultaneously. Even at its lowest fan setting, the present invention can also increase the temperature with or without the use of additional electrical energy. The lowest fan speed setting slows down the airflow to some degree, nonetheless the air has temperature changes because the vortex is still being compressed by the V-Cone. As the fans spin at a constant speed, the temperature can be adjusted by compressing the vortex to make changes to the hot and cold air product. This is done by setting the V-Cone at a desired depth or height in the main airflow separation tube hot end opening. The temperature adjustment mechanism is a two-phase system: The speed of the ducted fans and the positioning of the V-Cone work in correlation with each other when applying various temperature settings. The present invention has a dual approach when addressing temperature needs by using various combinations of assembly or individual processes to change temperature settings in real time.

These and other objectives of the present invention will become readily apparent upon further review of the following specifications and drawings. The apparatus can change the temperature with combinations of various assembly or be used as individual processes.

BRIEF DESCRIPTION OF THE DRAWINGS

FIG. 1*a* Top view of the ducted fan depicting the airflow pattern when the blades are spinning.

FIG. 8*a* Top view of the Vorxscrew Assembly and Heat Pump Exchanger in the closed position.

FIG. 8*b* Top view of the Vorxscrew Assembly and Heap Pump Exchanger in the open position.

FIG. 9 Isometric view of the instant invention in the open position with rotating spin chamber. Rotational direction shows how all parts work together to create hot and cold air by turning the apparatus on.

FIG. 9*a* Cross-sectional isometric view of interior of the rotating spin chamber.

FIG. 10 Front view of the invention installed in a typical home by replacing the current HVAC system with the instant invention.

FIG. 13 Exploded view of the instant invention where all parts are shown.

DETAILED DESCRIPTION OF THE PREFERRED EMBODIMENT

Figure 1:
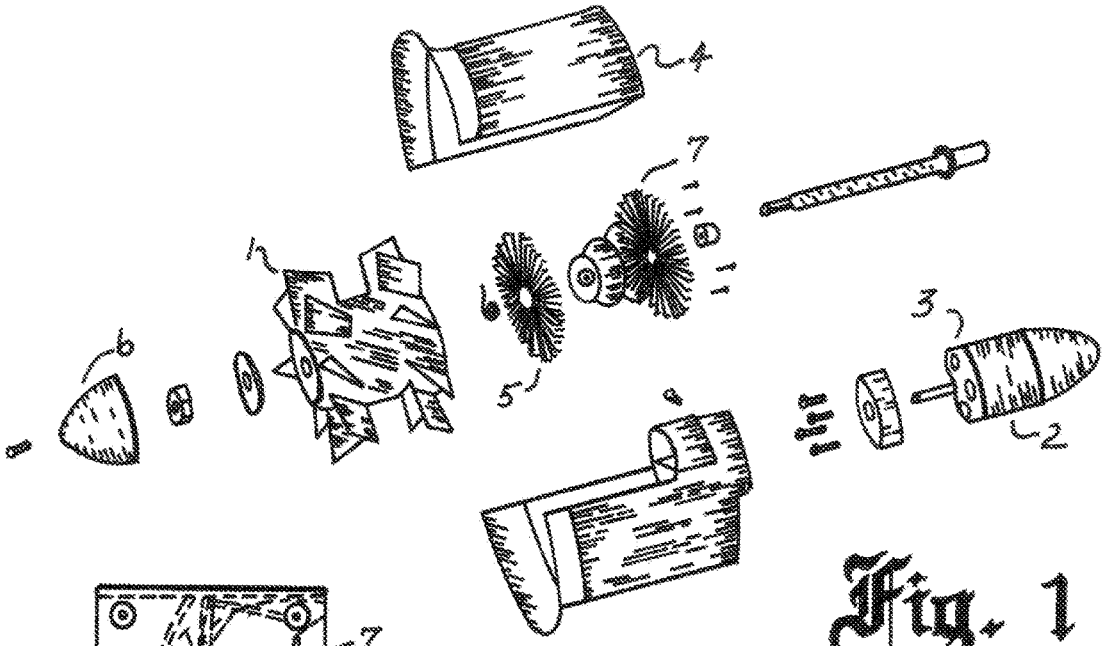
FIG. 1 Exploded view of a typical ducted fan assembly in the present invention.

Turning now descriptively to the drawings, similar reference characters denote like elements throughout the various views. The figures illustrate an example embodiment comprising of a high-speed fan delivery system, spin chamber, airflow gates, and rotating spin chamber.

The present invention engages by turning the ducted fans to the on position. FIG. 1 is an exploded view of a ducted fan which draws in ambient air into the HVAC On Demand Via High And Low-Pressure Vortex Separation Apparatus. A ducted fan normally has shorter blades than conventional propellers 1 and is mounted within a cylindrical shroud or duct 4. At the front of the ducted fan is a cone shaped cap 6 which allows the air to circulate more freely through the unit. The ducted fan advantageously reduces losses in velocity and pressure from the tips of the propeller blades by varying the cross-section of the duct.

Figure 1A:
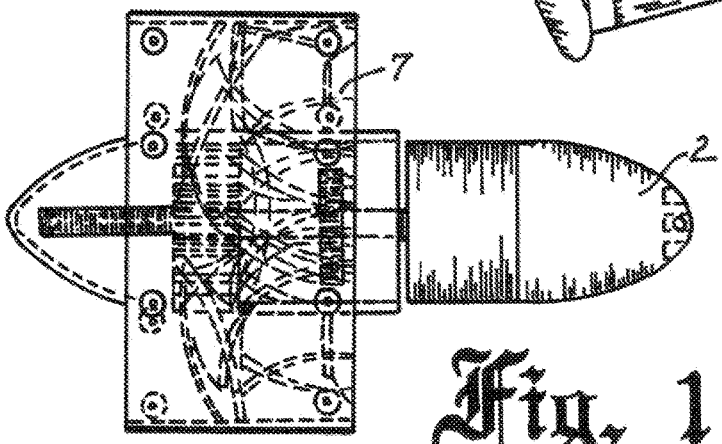

The ducted fans are equipped with an optional heat sensing clutch plate 5. The drive portion of a clutch plate typically rotates on a conventional engine with a pully. The other half of the clutch plate 7 rotates with the fan blade, this is called the driven portion. Since there is no pully in this fan clutch, it is constantly engaged until the temperature reaches a certain point. When this happens, the fan clutch disengages and stops the load on the fan blades. The ducted fans contain rotor blades 1, an electric motor 2 a stator 3, fan shroud 4, and an optional clutch plate 5. As air flows through the ducted fan, the blades spin in a centrifugal pattern. FIG. 1*a* is a top view of the ducted fan which shows the airflow pattern 7 when the blades are spinning.

Figure 2:
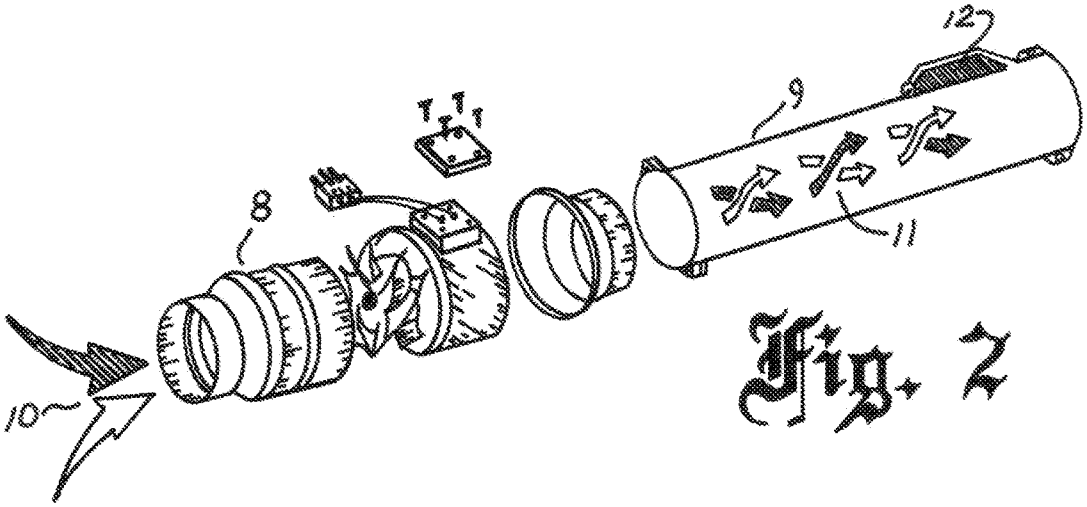
FIG. 2 Isometric view of a typical ducted fan assembly connected to the air delivery tubes.
Figure 3A:
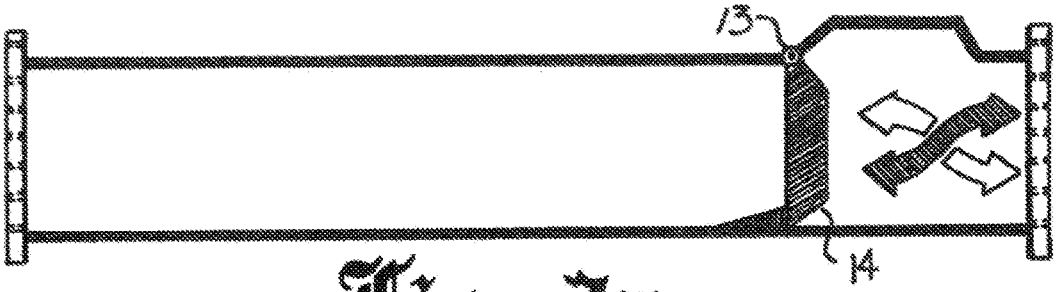
FIG. 3*a* Side view of the air delivery tube in the closed position.
Figure 3B:
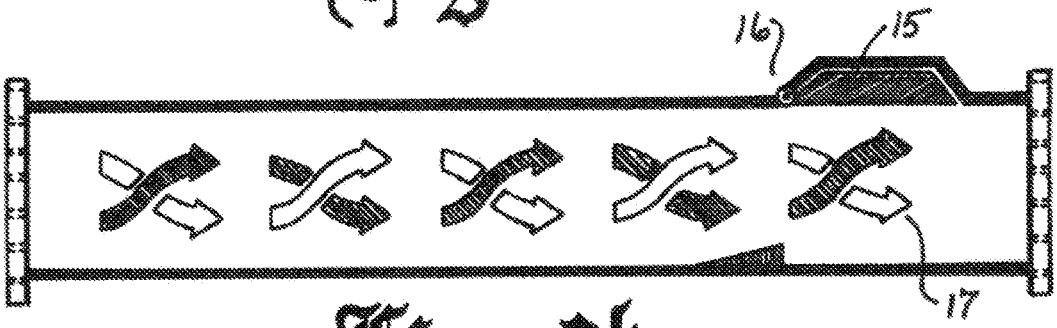
FIG. 3*b* Side view of the air delivery tube in the open position.

The ducted fans are connected to a series of air delivery tubes 9. FIG. 2. Shows an isometric view of a typical ducted fan 8 connected to an air delivery feed tube 9. The air delivery tube can be a variety of sizes depending on the application of the system. Once ambient air 11, as shown with the black and white arrows, enters the delivery tube 9 it starts to spiral into rotation. At the end of the delivery tube is a spring-loaded air backflow stop 12 which allows the air movement to only travel in only one direction. Once the airflow passes through the air delivery tubes, it pushes the air backflow stop into an open position. FIG. 3*a* is a side view of the air delivery tube in the closed position 13. If a ducted fan malfunctions, the closed position of the air backflow stop in that singular air delivery tube, keeps the airflow from exiting out of the delivery tube that the malfunctioned ducted fan is connected 14. This ultimately prevents backflow from all other fans contributing to the contained vortex in the spin chamber. FIG. 3*b* shows the air delivery tube in the open position 15. As soon as an individual ducted fan is turned on, the airflow pushes open the spring-loaded air backflow stop 16 and allows air to travel in only one direction 17. The airflow exits the air delivery tubes 9, which are connected to the chamber arms 18, via a flange 23, on the rotating spin chamber. The air is then directed through a series of interior baffles 24 and begins to spin around the horizontal tube 19.

Figure 4:
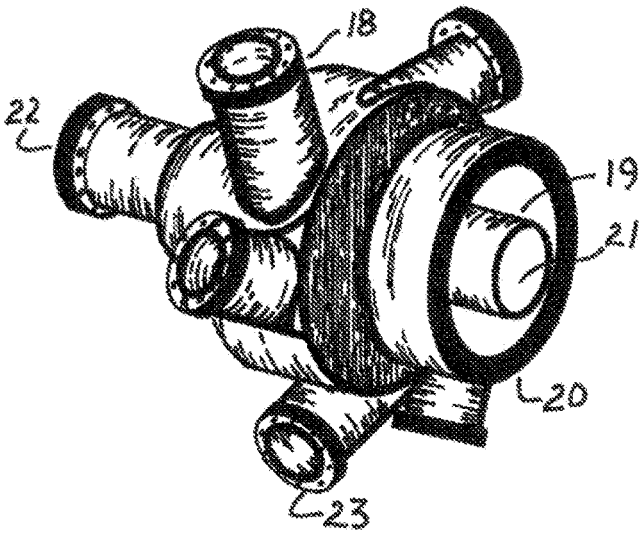
FIG. 4 Isometric view of the rotating spin chamber with a plurality of openings and depiction of the horizontal tube.

Further, FIG. 4 is an isometric view of the rotating spin chamber. The spin chamber can have a plurality of baffle positions 24 and the horizontal tube 19 is located inside the center of the rotating spin chamber. The rotating spin chamber extends to the front opening 20 where the generator is connected. The larger the application, the more air delivery tubes required. In this example, there are six delivery tubes with a hot 21 and cold 22 end. The hot end 21 is located to the right and the cold end 22 is located to the left. The air delivery tubes shown in FIG. 3*a* and FIG. 3*b* connect directly to the flange 23. There are varieties of methods to connect and disconnect them to the spin chamber. There are a plurality of air delivery tube(s) 9 designs and configurations to fit the need of the apparatus' application for residential, commercial, industrial, maritime, and United States Military purposes. As air enters the air delivery tubes 9, it starts a spiral motion which creates an instant vortex around the horizontal tube 19. While the centrifugal force of the vortex in the spin chamber keeps rotating, the angular momentum of the self-contained vortex continues to draw airflow in from all ducted fans.

Figure 5:
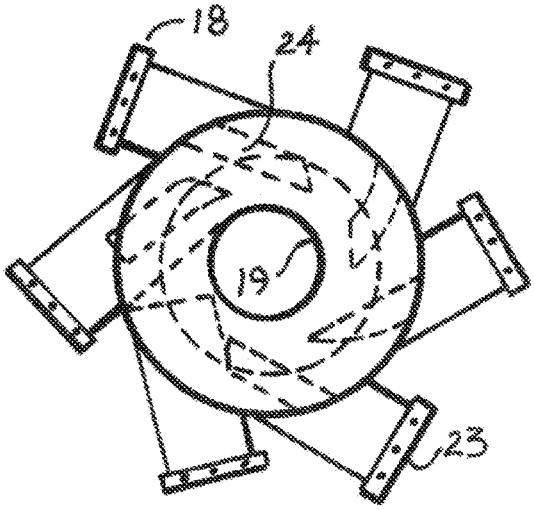
FIG. 5 Front view of the rotating spin chamber that shows where the inlet tubes are connected as well as the interior baffle extension positions around the horizontal tube.
Figure 5A:
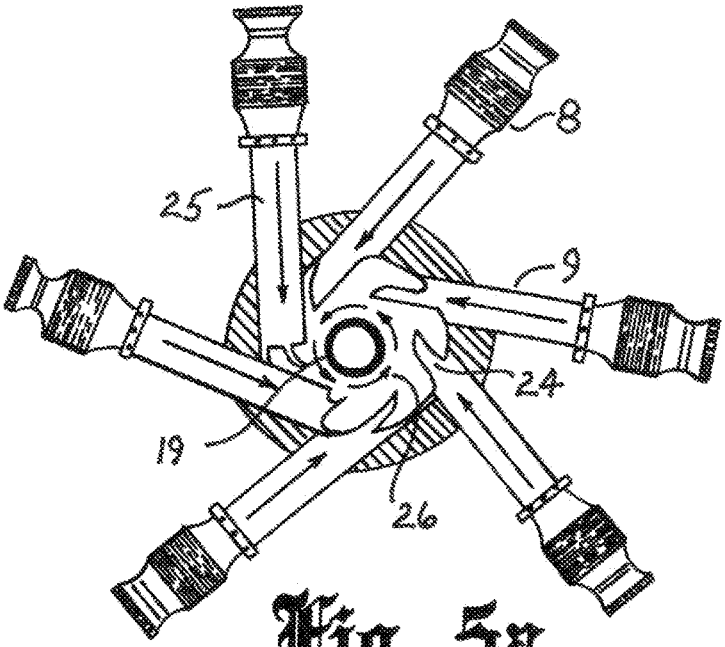
FIG. 5*a* Front cross-sectional view of the rotating spin chamber that depicts detailed views of the ducted fans, air delivery tubes, airflow direction, horizontal tube, and the vortex direction based on the positioning of the inlet tubes.

FIG. 5 is a front view of the spin chamber which shows the positioning configuration of the spin chamber and the extended baffle positions 24 of each chamber arm 18. You can also see the front of the horizontal tube 19. FIG. 5*a* shows a cross-section of a rotating spin chamber that depicts detailed views of the ducted fans 8, air delivery tubes 9, airflow direction 25, horizontal tube 19, the counterclockwise vortex direction of the airflow 26, and the configuration of the airflow delivery tubes 9. The delivery tubes can also be reversed to form the initial vortex in a clockwise direction as stated by changing their positions. Note, +that the extended baffle positions 24 are arranged in such a way that each baffle extends more than the previous baffle creating a perfectly optimized fast spinning vortex.

Figure 6:
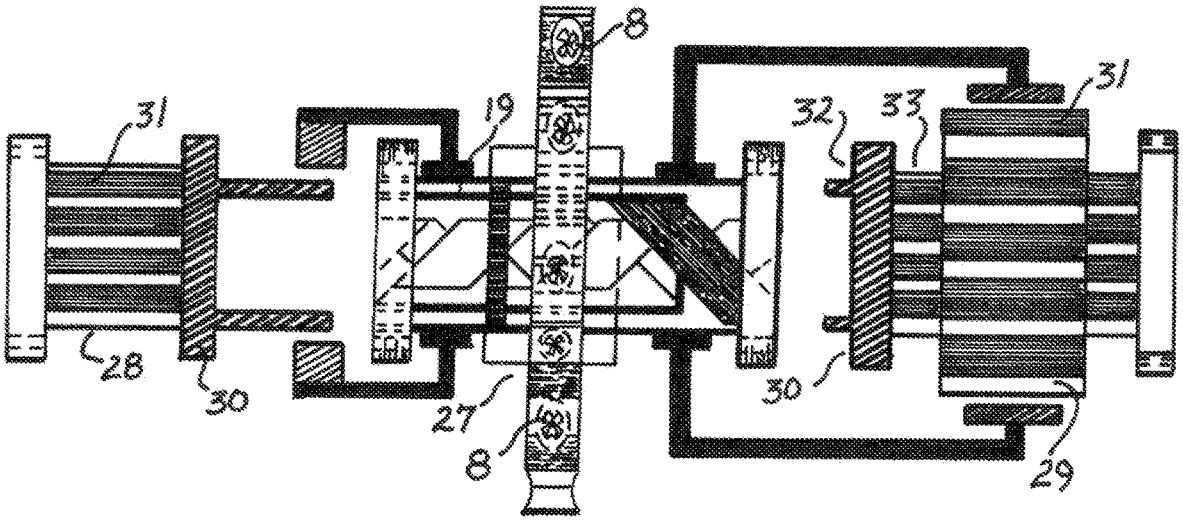
FIG. 6 Side cross-sectional view of the rotating spin chamber connected to the left and right electrical generators positioned on both sides of the rotating spin chamber.

As the vortex is created around the horizontal tube 19, the rotating spin chamber uses the centrifugal force of the vortex with the assisted vacuum of the ducted fans 8 as well. This creates momentum for the rotating spin chamber to spin in the opposite direction. FIG. 6 is a front cross-sectional view of the rotating spin chamber 27 connected to the left generator 28, positioned on the left side of the rotating spin chamber 27, and the right generator 29 located on the right side of the rotating spin chamber 27. They are connected via magnetic bearings 30 at the front and back of the spin chamber, which allows the rotating spin chamber 27 to rotate in a near frictionless environment. As the spin chamber rotates, it turns a coil generator 31 on both sides of the apparatus and captures the mechanical energy instantly as it spins. This increases the efficiency of the entire unit by converting mechanical energy into electrical energy that would otherwise be wasted. A magnetic bearing 32 is a type of bearing that supports a load using magnetic levitation without physical contact. These near frictionless bearings allow levitation on a rotating shaft and permit relative motion with low friction and no mechanical wear. Magnetic bearings 32, or the like, support the highest speeds of any kind of bearing and have no maximum relative speed. Electrical contacts on both generators close the circuit and the allow mechanical energy from the rotating spin chamber to spin and move electron charges in the wire of its windings 33. This converts the mechanical energy into additional electrical energy, which can directly recycle back into the unit.

Figure 7:
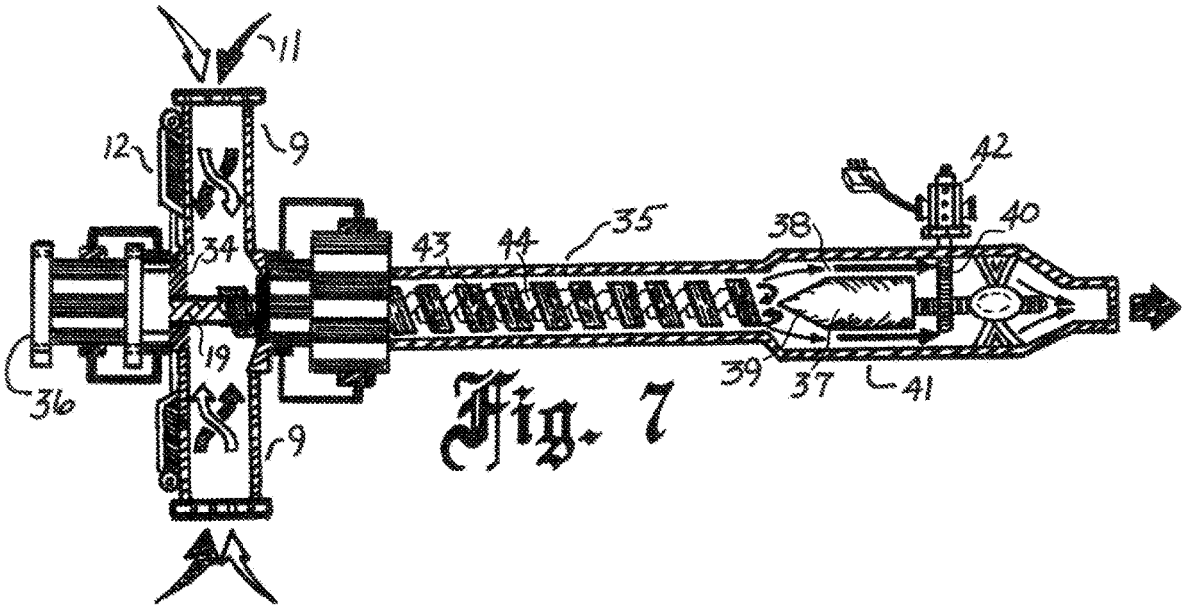
FIG. 7 Right side cross-sectional view of the rotating spin chamber with left and right generators, main airflow separation tube, and Vorxscrew Assembly mechanism with motor that controls its position.

As the rotating spin chamber creates an interior vortex in one direction, while the chamber itself spins in the opposite direction, the interior vortex originates in the main airflow separation tube 35. FIG. 7 is a right-side cross-sectional view of the rotating spin chamber 27, left and right generators, main airflow separation tube 35, and Vorxscrew Assembly mechanism 41. As air 11 enters the air delivery tubes 9 (shown by the black and white arrows), it arrives at the spin chamber and rotates in a counterclockwise position around the horizontal tube 19. The left wall 34 keeps the vortex from moving to the left or back of the unit and forces the vortex to travel right directly towards the Vorxscrew Assembly 41.

When the invention is turned on with its lowest setting, it forces a spiral motion around the main air separation tube 35 and the excess airflow has nowhere to go so it creates a backdraft suction effect at the rear of the unit 36. This backdraft is created automatically no matter what speed setting the ducted fans are on or how fast the vortex is spinning. As the airflow spins toward the front of the apparatus, the molecules in the hot air 43 when comparing volume of air introduced to the apparatus, the hot and cold air molecules share different properties. The hot air 43 molecules (Black lines) are moving at a much faster rate than the molecules of the cold air 44 (White lines). Because of this, the molecules in the hot air tend to be further apart from each other, giving the hotter air a lower density. In contrast, the cold air becomes denser with weighted molecules.

As the V-Cone 37 is slightly closed, it limits the space 38 where the air molecules can fit through the front opening to exit. For this reason, since the molecules in the hot air are less dense than the cold air, the opening only allows the hot air molecules to pass through the opening before any cold air molecules can pass through. The faster the vortex spins; the least amount of cold air molecules can enter because the less dense hot air molecules are pushed through first. This allows it to get hotter when the vortex is spinning faster and specifically when the position of the V-Cone 37 is tightened closed. Since the vortex never stops, it mostly allows the less dense (lighter or hot air) to pass through first.

Since there is no room for the larger cold air molecules to exit the front of the Vorxscrew Assembly 41 as it is adjusted more closed, there is only one place they can go. They automatically keep spinning in the same direction and are forced onto the exposed angle of 39 of the V-Cone 37. Since the cold air molecules are denser than the hot air molecules, they spin around the V-Cone 37 and follow the path of least resistance through the center of the outer perimeter self-contained vortex.

Once the spinning air arrives at the Vorxscrew Assembly 41, the V-Cone 37 and Gear Mechanism 40 forces the low pressure (cold air 44) into a reverse direction down the center of the high-pressure vortex. The cold air then enters the center of the horizontal tube 19 leading to the left side of the apparatus and the cold air exits out the back side of the apparatus.

The Vorxscrew Assembly 41 to the right of the apparatus consists of a V-Cone 37, Screw Gear Mechanism 40, a motor 42, which opens and closes the V-Cone 37 and a Screw Gear Mechanism 40. Screw gears are used for offset shafts that are perpendicular to each other that mate the gears so that when the motor 42 turns, it opens and closes the V-Cone 37. As the V-Cone 37 closes the space 38 tighter, it increases the high pressure of the vortex and the hot air 43 increases in temperature and the cold air 44 temperature drops simultaneously.

Figure 8A:
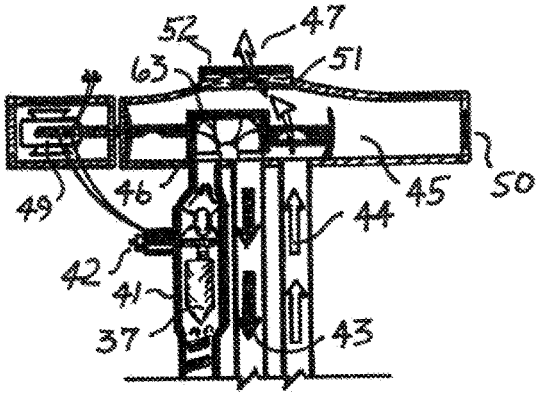

FIG. 8*a* is a top view of the Vorxscrew Assembly 41 and Heat Pump Exchanger 45 in the closed position 46. When the heat pump exchanger 45 is in the closed position 46, hot air 43 is diverted to the rear of the apparatus via a 360-degree fitting 63. This allows the cold air 44 to exit the front 47. The heat pump exchanger 45 has a metal chassis that houses the 180-degree return fitting 63. This fitting allows the airflow to reverse in the opposite direction when used in combination with the drive motor 49 that opens and closes the fitting by moving the metal chassis back and forth. The heat pump exchanger 45 also contains a plurality of vent openings 50 that allow ambient air to mix with the hot or cold air. These openings house filters that eliminate air born contaminants throughout the entire system. This filtered ambient airflow when mixed hot and cold air creates a perfect temperature setting which is controlled by thermostat.

The Heat Pump Exchanger 45 contains a thermocouple 51 located directly behind the main front turbine fan that senses the temperature and controls the position of the V-Cone 37. This works in combination with any typical wall mounted thermostat and controls the temperature of the airflow that is distributed throughout the building.

Figure 8B:
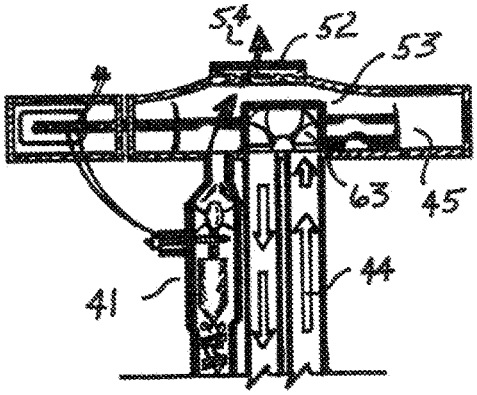

FIG. 8*b* is a top view of the Vorxscrew Assembly 41 and Heap Pump Exchanger 45 in the open position 53. When the heat pump exchanger is in the open position 53, hot air 43 is forced out the front of the unit 54 by the main turbine fan 52. The cold air 44 is diverted to the back of the unit where it exits through the rear exhaust fan. All aspects of the heat pump exchanger 45 work the same as described in FIG. 8*a* with the exception that it is in the open position 53 instead of closed.

Figure 8C:
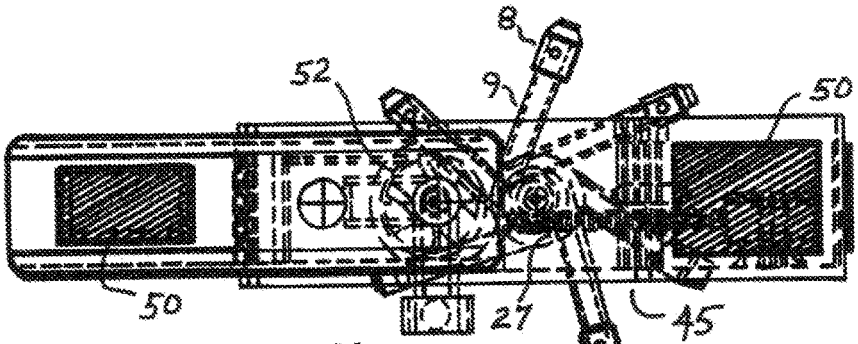
FIG. 8*c* Front view of the Heap Pump Exchanger, main turbine fan, and vent openings.

FIG. 8*c* is a front view of the heat pump exchanger 45 which shows a detailed view of the plurality of vent openings 50 that allow ambient air to mix with the hot or cold air, ducted fans 8, air delivery tubes 9, and the rotating spin chamber 27. It also displays the positioning of the main turbine fan 52 located at the front of the unit.

Figures 9, 9A:
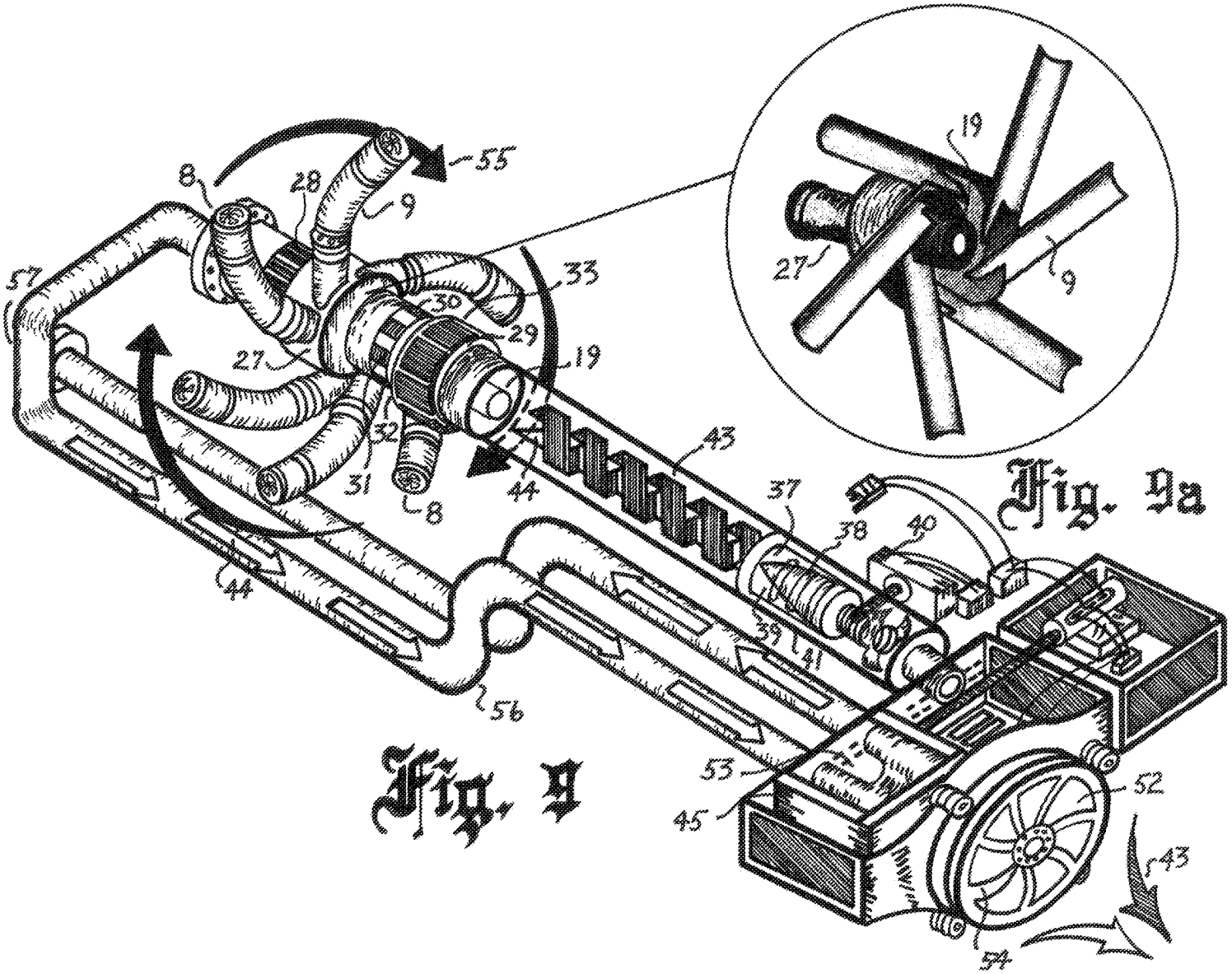

The main unit comprises of all the parts mentioned above connected to create an efficient system. FIG. 9 is an isometric view of the present invention in the open position 53 which shows how all parts work together and create hot air 43 and cold air 44 by simply turning on the unit. As airflow is drawn into the ducted fans 8, it is forced through the air delivery tubes 9 and enters the rotating spin chamber 27. As air passes through the ducted fans 8, it creates a vacuum and rotates the rotating spin chamber 27 in the direction of the vacuum 55. In this configuration, the rotating spin chamber 27 is revolving clockwise 55. As the airflow, that is generated by the ducted fans 9, is drawn into the rotating spin chamber 27, it spins in a counterclockwise direction around the horizontal tube 19. As it creates a vortex and begins to spin, it is forced to the front of the apparatus.

Contributively, as the rotating spin chamber 27 starts to spin, it converts mechanical energy to electrical energy, via a generator 28 positioned on the left side of the rotating spin chamber 27 and a right generator 29 located on the right side of the rotating spin chamber 27. They are connected via magnetic bearings 30, or the like, at the front and back of the spin chamber that allow the spin chamber 27 to rotate in a near frictionless environment. As the rotating spin chamber 27 revolves, it turns a coil generator 31 placed on both sides that captures the mechanical energy as it spins and converts it into electrical energy.

This increases the efficiency of the entire unit by capturing energy that would otherwise be wasted. A magnetic bearing 32, or the like, is a type of bearing that supports a load using magnetic levitation without physical contact. These near frictionless bearings enable levitation from a rotating shaft and permit relative motion with low friction and limit mechanical wear. Magnetic bearings 32 support the highest speeds of any kind of bearing and have no maximum relative speed. Electrical contacts on both generators will close the circuit and enable mechanical energy from the rotating spin chamber to move electron charges into the wire of its windings 33 and convert the mechanical energy that would be otherwise be wasted into additional electrical energy which can be recycled back into the unit.

As the airflow spins toward the front of the apparatus, the molecules in the hot air 43 (Black lines) are moving at a much faster rate than the molecules of the cold air 44 (White lines). Because of this, the molecules in the hot air tend to be further apart from each other, giving the hot air a lower density. This means, that for the same volume of air, cold air has a higher rate of molecules and becomes even more dense.

As the V-Cone 37 is slightly closed, it limits the space 39 where the less dense air molecules can travel first through the front opening to exit. The air molecules in the hot air are less dense than that of cold air; the opening only allows the hot air molecules to pass through before any cold air molecules can pass through.

As stated previously, since there is no room for the denser cold air molecules to exit the front of the V-Cone 37 as it is adjusted to a closed setting 38, there is only one place they can go. They automatically keep spinning in the same direction and are forced onto the angled face of the V-Cone 37. Since the cold air molecules are more dense than the hot air molecules, they spin around the V-Cone 37 and follow the path of least resistance through the center of the separation chamber which happens to be the center of the outer perimeter vortex.

In this example, the heat pump exchanger 45 is on the open position. When in the open position, it allows the hot air to travel to the front of the unit while redirecting the cold air through a series of reversing tubes 56. These tubes allow the airflow to switch directions by changing the position of the heat pump exchanger 45.

Once the spinning vortex air hits the Vorxscrew Assembly 41, the V-Cone 37 and Gear Mechanism 40 forces the low pressure (cold air 44) into a reverse direction down the center of the high-pressure vortex. The cold air then enters the center of the horizontal tube 19 leading to the left side of the unit and the cold air exits out the back side of the unit.

The Vorxscrew Assembly 41 on the right side of the apparatus consists of a V-Cone 37, Screw Gear Mechanism 40, a motor 42, which opens and closes the V-Cone 37 and a Screw Gear Mechanism 40. Screw gears are used for offset shafts that are perpendicular to each other that mate the gears so that when the motor turns, it opens and closes the V-Cone 37.

As the V-Cone 37 closes the space 38, it increases the high-pressure of the vortex and the hot air 43 gets hotter and the cold air 44 gets colder simultaneously. The hot airflow is forced out of the main front turbine fan 52 and diverts the cold air to the back of the unit 57.

This self-containing vortex spin chamber is the heart of invention. It is not limited to any size or configuration; giving it the ability to be scaled to fit all applications.

Further noted, FIG. 9*a* is a cross section isometric view of the interior of the rotating spin chamber 27. It depicts how each baffle location is positioned to create an efficient vortex.

Turning to all future applications of the instant invention, FIG. 10 is a front view of the apparatus installed in a typical home by replacing the current HVAC system. Starting at the top left is the existing return air system 58 installed in a typical home. As you follow the ambient air through the duct work 59, it is connected directly 60 to one of the ducted fans 8 that takes in air. This configuration is variable and multiple fan combinations can be used the draw the return air in from the home.

Once the ducted fans 8 draw in ambient air 11 it enters the rotating spin chamber 27 and circulates around the horizontal tube 19. This creates a rotating vortex as explained above. The vortex 61 created forces circular airflow through the main air flow separation tube 35 where the variably adjustable V-Cone 37 allows the hot air 43 molecules to pass through the front and forces the cold air 44 molecules down the center of the main vortex.

As you follow the hot air up the main airflow separation tube 35 and Vorxscrew Assembly 41, note the heat pump exchanger 45 is in the closed position where it enters the 180-degree return fitting 63. As you follow the hot air down through the exit fan at the bottom 64, it loops back to the roof of the house where it is exhausted through a roof vent 65.

Also note, the cold air 44 exiting the bottom of the system. The cold air passes through another 180-degree fitting 66 and travels back to the top of the heat pump exchanger 45 where it is locked in the closed position. Since the heat pump exchanger is in the closed position, the cold air 44 flows directly to the front of the unit where it mixes with ambient air and the main turbine fan 52 at the front of the unit, which passes the cold air 44 through the duct work 67 and throughout the vent openings 68 into the house. A thermocouple 51 controls the positioning of the V-Cone motor 42 and creates a temperature based on the preferred setting of the thermostat.

Figure 11:
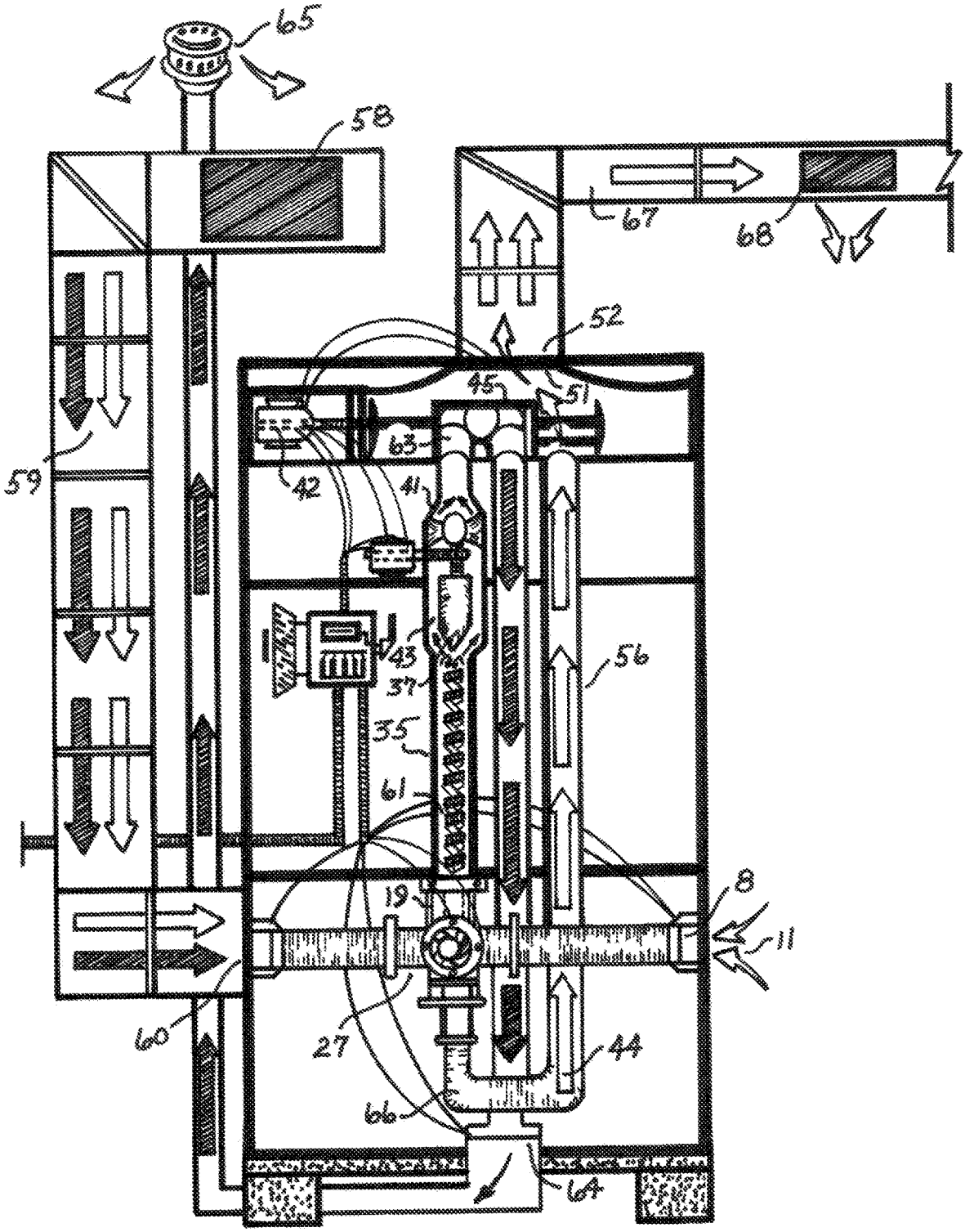
FIG. 11 Isometric view of a typical window air conditioning system using the instant invention.
Figure 11:
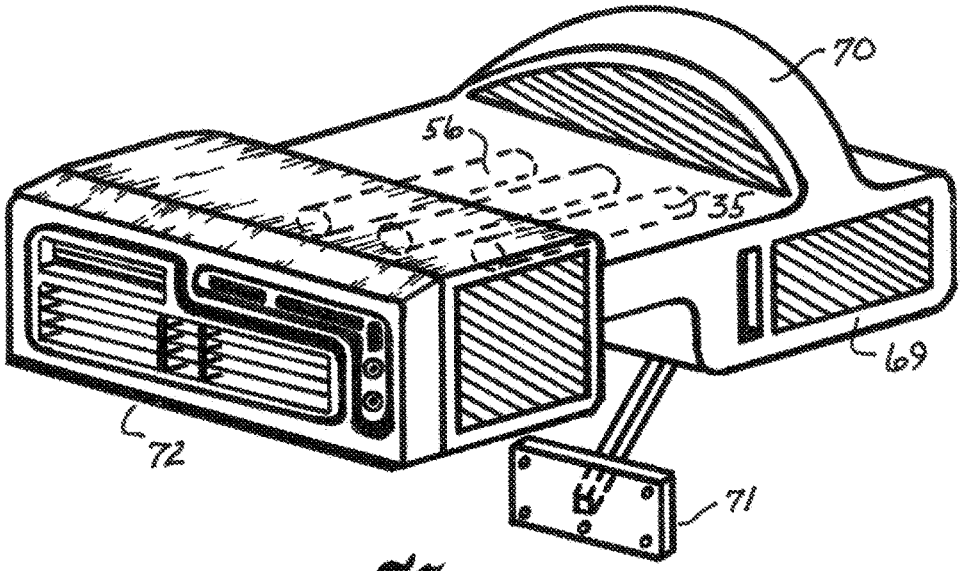

In small residential applications for cooling a typical room, FIG. 11 denotes an isometric view of a window air-conditioner using the present invention. It works in the same way as most other residential window air-conditioning units. However, it has the present invention installed. Note, the ducted fans are contained in a circular covering 70 which encircles the entire unit. Also shown, is the main airflow separation tube 35 and reversing tubes 56. It also includes air inlet vents 69 where the rotating spin chamber can receive its ambient air. This example also has an extracting wall mount 71 to help secure the unit to the outside wall. Hot and cold air is forced through the front of the unit 72 by the positioning of the internal heat pump exchanger to the desired position.

Figure 12:
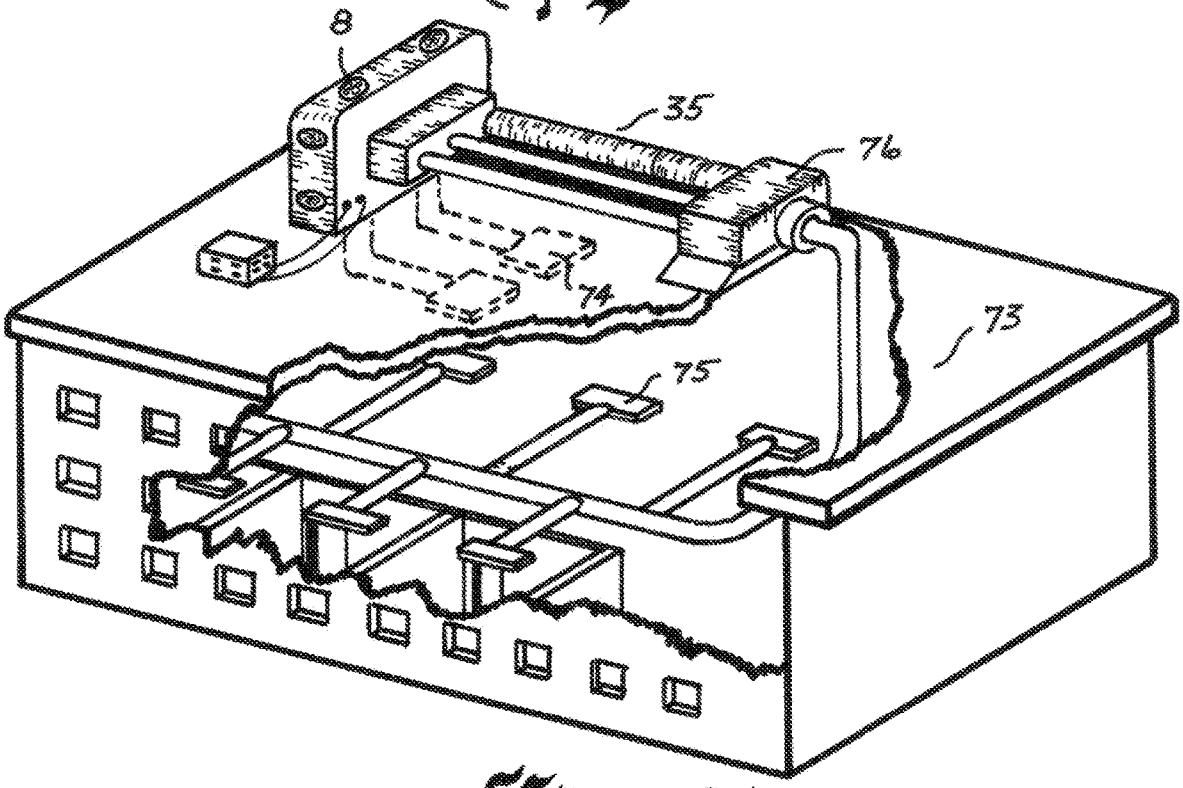
FIG. 12 Isometric view of a typical commercial building that uses the instant invention as its heating and cooling source.

In commercial applications, the present invention is scalable and can be installed on a roof of a commercial building. FIG. 12 is an isometric view of a typical commercial building that uses the invention as its heating and cooling system. The main unit is much larger and can be installed on the roof 73 of the building. This example demonstrates how commercial applications of the invention can be scaled up with a larger system that can heat and cool an entire building throughout its interior ductwork 75. The return air is connected as well to a plurality of duct inlet openings 74. On the front of the unit is a housing 76 that contains the heat pump exchanger. Once hot or cold air is generated, it is forced thorough a series of duct work throughout the building. Multiple systems can be placed on the roof of the building for heating and cooling within specific zones.

Concluding, FIG. 13 is an exploded view of the HVAC On Demand Via High and Low Pressure Vortex Separation Apparatus where all parts are shown. Note that the invention is not limited to the scope in this description and covers all aspects of scalable heating and cooling solutions in this preferred embodiment.

Unless otherwise defined, all technical and scientific terms used herein have the same meaning as commonly understood by one of ordinary skill in the art to which this invention belongs. The instant invention may be embodied in other specific forms without departing from the spirit or essential attributes thereof, and it is therefore desired that the present embodiment be considered in all respects as illustrative and not restrictive.

I claim:

1. A scalable heating and cooling apparatus, comprising:

a ducted fan including a plurality of air delivery tubes, wherein the plurality of air delivery tubes are tangentially inserted into the ducted fan, with a baffle disposed at a distal end of each of said plurality of air delivery tubes;

a first electrical generator adjacent the ducted fan on a first side;

a second electrical generator adjacent the ducted fan on a second side, opposite the first side;

a main airflow separation tube adjacent the second electrical generator, such that the second electrical generator is directly between the second side of the ducted fan and a first side of the main airflow separation tube;

an assembly comprising a motor and a V-cone attached to a gear, the assembly disposed adjacent the main airflow separation tube at a second side of the main airflow separation tube, opposite the first side of the main airflow separation tube, such that the main airflow separation tube is directly between the second electrical generator and said assembly;

a heat pump heat exchanger adjacent the assembly, such that the assembly is directly between the main airflow separation tube and the heat pump heat exchanger, the heat pump heat exchanger including a main turbine fan disposed opposite where the heat pump heat exchanger attaches to the assembly, a first reversing tube extending substantially parallel to the main airflow delivery tube, and a second reversing tube extending substantially parallel to the main airflow delivery tube;

wherein, the plurality of air delivery tubes extend radially beyond a maximum diameter of the first and second electrical generators, one end of the first reversing tube or the second reversing tube connects to the first electrical generator, such that the first electrical generator is located directly between the one end and the ducted fan, the main airflow separation tube has an outer diameter smaller than a diameter of the second electrical generator and a diameter of the assembly, and the V-cone and the gear are connected via a shaft, and the motor is perpendicularly linked to said shaft directly between the V-cone and the gear.

* * * * *